United States Patent [19]

Fukui

[11] Patent Number: 4,979,487

[45] Date of Patent: Dec. 25, 1990

[54] IGNITION CONTROLLING APPARATUS FOR MULTI-CYLINDER INTERNAL COMBUSTION ENGINE

[75] Inventor: Wataru Fukui, Himeji, Japan

[73] Assignee: Mitsubishi Denki Kabushiki Kaisha, Tokyo, Japan

[21] Appl. No.: 489,625

[22] Filed: Mar. 7, 1990

[30] Foreign Application Priority Data

Mar. 8, 1989 [JP] Japan ..... 1-53875

[51] Int. Cl.[5] ..... F02P 3/12

[52] U.S. Cl. ..... 123/643

[58] Field of Search ..... 123/643, 594, 602, 617, 123/621, 479, 416; 73/118.1; 364/431.07

[56] References Cited

U.S. PATENT DOCUMENTS

| | | | |
|---|---|---|---|
| 4,112,895 | 9/1978 | Habert | 123/643 |
| 4,485,784 | 12/1984 | Fujii et al. | 123/643 |
| 4,527,522 | 7/1985 | Carory | 123/416 |
| 4,572,151 | 2/1986 | Toyama | 123/643 |
| 4,681,082 | 7/1987 | Onogi et al. | 123/643 |
| 4,825,691 | 5/1989 | Sckiguchi | 73/118.1 |
| 4,856,489 | 8/1989 | Ozawa | 123/643 |
| 4,870,587 | 9/1989 | Kumagai | 364/431.07 |

*Primary Examiner*—Raymond A. Nelli

*Attorney, Agent, or Firm*—Sughrue, Mion, Zinn, Macpeak and Seas

[57] ABSTRACT

An ignition controlling apparatus of a multi-cylinder internal combustion engine which distinguishes successively at least one cylinder to be ignited among plural cylinders of the internal combustion engine, distributes an ignition controlling signal switching on/off an ignition coil on the basis of successively distinguishing information, and stores and learns the distinguishing information, thereby being capable of distinguishing cylinders normally according to the stored and learned distinguishing information even when it is impossible to distinguish cylinders.

10 Claims, 5 Drawing Sheets

| B5° SGCn-1 | B75° SGCn | CYLINDER | IGNITION COIL |
|---|---|---|---|
| 0 | 0 | 1, 4 | 13a |
| 1 | 1 | 2, 5 | 13b |
| 0 | 1 | 3, 6 | 13c |

IGNITION CONTROLLING APPARATUS FOR MULTI-CYLINDER INTERNAL COMBUSTION ENGINE

BACKGROUND OF THE INVENTION

1. Field of the Invention

This invention relates to an ignition controlling apparatus of a multi-cylinder internal combustion engine, especially to an ignition controlling apparatus which distinguishes cylinders to be ignited of the internal combustion engine, and carries out ignition controlling of the distinguished cylinders.

2. Description of Related Art

FIG. 1 is a block diagram showing a construction of a conventional ignition controlling apparatus of a low voltage distribution method with three ignition coils which is applied in six-cylinder internal combustion engine (hereinafter to be called engine). In the figure, reference numeral 1 is a disc-like first rotor which is driven by a cam shaft (not shown) of the engine, and rotates in the direction of an arrow. On the peripheral surface of the first rotor 1, six pieces to be detected 2, 2 . . . having same circumferential lengths are fixed with equal intervals from the one to the next. At the position which opposes to the peripheral surface of the first rotor 1, there is provided an angle detector 3 which employs a proximity switch, for example. The angle detector 3 detects the pieces to be detected 2, 2 . . . and outputs a first pulse signal SGT of a waveform shown in FIG. 2(*a*), which indicates a referential position $\theta r$ of rotational direction of each cylinder. The first pulse signal SGT is the one whose period and width are constant when rotating speed is constant, and the angle detector 3 outputs six pulses which falls at 75° before top dead center (B75°) of each cylinder and rises at 5° before top dead center (B5°) thereof when the engine rotates once. And the cam shaft drives a second rotor 4 in the direction shown by an arrow in the same way as the first rotor 1. On the peripheral surface of the second rotor 4, two kinds of pieces to be detected 5, 5' . . . whose circumferential lengths are different from each other are fixed two by two. The pieces to be detected 5, 5' are fixed to be opposed to each other, the circumferential length of the piece 5' being shorter than that of the piece 5. In addition, intervals between the piece 5 and the piece 5' are not equal, that is, one being longer than the other. At the position which opposes to the peripheral surface of the second rotor 4, there is provided a cylinder detector 6 which employs a proximity switch, for example. The cylinder detector 6 detects the pieces to be detected 5, 5' . . . and outputs a second pulse signal SGC of a waveform shown in FIG. 2(*b*). The waveform of the second pulse signal SGC corresponds to the circumferential lengths and allocated positions of the pieces to be detected 5, 5' . . . . That is, the width of the detected pulse of the piece to be detected 5' is shorter than that of the piece to be detected 5, one pulse interval being shorter than the other pulse interval. The first pulse signal SGT from the angle detector 3 is outputted respectively to a period measuring unit 7 for measuring a period T of the first pulse signal SGT, a timer 10 and a cylinder distinguishing unit 11 to be described later. The second pulse signal SGC from the cylinder detector 6 is given to the cylinder distinguishing unit 11 which outputs a cylinder distinguishing signal (to be described later) for distinguishing specific cylinders to be ignited next according to a phase between the first pulse signal SGT and the second pulse signal SGT.

The period T outputted from the period measuring unit 7 is given to an angle-time calculating unit 9. A target ignition timing calculating unit 8, which calculates a target ignition timing $\theta$ according to engine information such as engine speed, boost pressure and so on, gives the target ignition timing (indicated by $\theta$) to the angle-time calculating unit 9. The angle-time calculating unit 9 calculates a time $t_a$ corresponding to an angle from the referential position $\theta r$ to the target ignition timing $\theta$ by the equation $t_a=(\theta r-\theta)\cdot T/120$ on the basis of the period T and target ignition timing $\theta$. The calculated time $t_a$ is given to a timer 10. The timer 10 outputs an ignition controlling signal afer the time $t_a$ passes from the time when the engine has reached the referential position $\theta$, with the position of the falling edge of the first pulse signal SGT given from the angle detector 3 being the referential position $\theta$. The ignition controlling signal outputted from the timer 10 and the cylinder distinguishing signal outputted from the cylinder distinguishing unit 11 are given to a distributor 12. The distributor 12 distributes the ignition controlling signal to three transistors 14*a*, 14*b*, and 14*c* corresponding to the cylinder distinguishing signal. The transistors 14*a*, 14*b*, and 14*c* switches on/off ignition coils 13*a*, 13*b*, and 13*c* according to the distributed ignition controlling signal, thereby carrying out an ignition operation.

FIG. 3 is a drawing explaining the method for distinguishing cylinders.

Here, n indicates a detecting timing of this time of the angle detector 3. In the ignition controlling apparatus of the aforesaid conventional internal combustion engine, as shown in FIG. 3, by sampling the second pulse signal SGC at the rising edge (B5°) and falling edge (B75°) of the first pulse signal SGT, the level of "0" or "1" thereof is judged, then cylinders to be ignited next are distinguished. That is, 1 and 4 cylinders are distinguished when B5°="0", B75°="0", 2 and 5 cylinders when B5°="1", B75°="1", and 3 and 6 cylinders when B5°="0", B75°="1".

When noise is superimposed in the first pulse signal SGT and the second pulse signal SGC shown in FIG. 2, normal cylinder distinguishing is not carried out, thereby wrong cylinders being sometimes ignited. In this case, there is a problem that engine is damaged.

SUMMARY OF THE INVENTION

This invention has been devised in order to solve the aforementioned conventional problem.

The primary object of the present invention is to provide an ignition controlling apparatus of an internal combustion engine which enables to distinguish cylinders normally even when abnormality is generated in distinguishing information due to noise. In order to attain the object, the apparatus stores successively distinguishing information outputted from the cylinder distinguishing unit, learns the stored order, compares the distinguishing information of the learned result with the outputted distinguishing information, and judges abnormality of the distinguishing information of cylinders. When abnormal, it carried out ignition controlling with the use of a distinguishing signal of the learned result.

Another object of the present invention is to provide an ignition controlling apparatus of an internal combustion engine which enables to distinguish cylinders normally even when abnormality is generated in the learned result due to noise. In order to obtain the object, the apparatus stores successively distinguishing information outputted from the cylinder distinguishing unit, learns the stored order, and compares the distinguishing information of the learned result with the outputted distinguishing information. In the case where the compared results do not coincide with each other predetermined times or more, the distinguishing information of cylinders of the learned result is judged to be abnormal, the apparatus carrying out ignition controlling with the use of a distinguishing signal from the cylinder distinguishing unit.

The above and further objects and features of the invention will more fully be apparent from the following detailed description with accompanying drawings.

DESCRIPTION OF THE PREFERRED EMBODIMENTS

Figure 4:
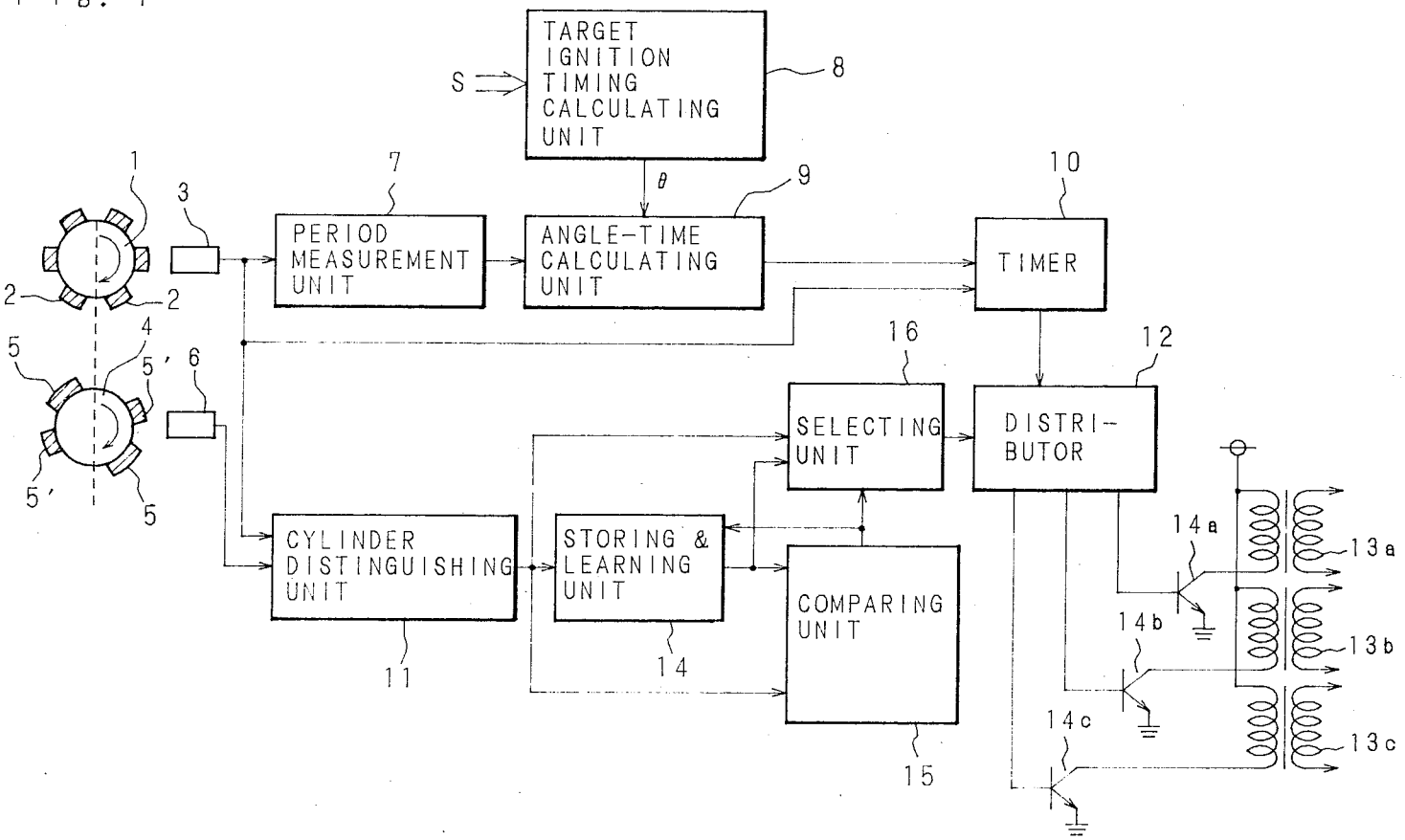
FIG. 4 is a block diagram showing a construction of an ignition controlling apparatus of an internal combustion engine of one embodiment of the invention.

FIG. 4 is a block diagram showing a construction of an ignition controlling apparatus according to the invention of a low voltage distribution method with three ignition coils which is applied in six-cylinder internal combustion engine (hereinafter to be called engine). In the figure, reference numeral 1 is a disc-like first rotor which is driven by a cam shaft (not shown) of the engine and rotates in the direction of an arrow. On the peripheral surface thereof, six pieces to be detected 2, 2 . . . having equal circumferential lengths being fixed with equal intervals from the one to the next. At the position which opposes to the peripheral surface of the first rotor 1, there is provided an angle detector 3 which employs a proximity switch, for example. The angle detector 3 detects the pieces to be detected 2, 2 . . . and outputs a first pulse signal SGT of a waveform shown in FIG. 2(*a*), which indicates a referential position $\theta r$ of rotational direction of each cylinder. The first pulse signal SGT is the one whose period and width are constant when rotating speed is constant, and the angle detector 3 outputs six pulses which falls at 75° before top dead center (B75°) of each cylinder and rises at 5° before top dead center (B5°) thereof when the engine rotates once. And the cam shaft drives a second rotor 4 in the direction shown by an arrow in the same way as the first rotor 1. On the peripheral surface of the second rotor 4, two kinds of pieces to be detected 5, 5' . . . whose circumferential lengths are different from each other are fixed two by two. The pieces to be detected 5, 5' are fixed to be opposed to each other, the circumferential length of the piece 5' being shorter than that of the piece 5. In addition, intervals between the piece 5 and the piece 5' are not equal, that is, one being longer than the other. At the position which opposes to the peripheral surface of the second rotor 4, there is provided a cylinder detector 6 which employs a proximity switch, for example. The cylinder detector 6 detects the pieces to be detected 5, 5' . . . and outputs a second pulse signal SGC of a waveform shown in FIG. 2(*b*). The waveform of the second pulse signal SGC corresponds to the circumferential lengths and allocated positions of the pieces to be detected 5, 5' . . . . That is, the width of the detected pulse of the piece to be detected 5' is shorter than that of the piece to be detected 5, one pulse interval being shorter than the other pulse interval. The first pulse signal SGT from the angle detector 3 is outputted respectively to a period measuring unit 7 for measuring a period T of the first pulse signal SGT, a timer 10 and a cylinder distinguishing unit 11 to be described later. The second pulse signal SGC from the cylinder detector 6 is given to the cylinder distinguishing unit 11 which outputs a cylinder distinguishing signal (to be described later) for distinguishing specific cylinders to be ignited next according to a phase between the first pulse signal SGT and the second pulse signal SGC.

The period T outputted from the period measuring unit 7 is given to an angle-time calculating unit 9. To the angle-time calculating unit 9, a target ignition timing $\theta$ is also given from a target ignition timing calculating unit 8 which calculates the target ignition timing $\theta$ according to engine information S such as engine speed and boost pressure, for example. On the basis of the period T and target ignition timing $\theta$, the angle-time calculating unit 9 calculates a time $t_a$ indicating time from the referential position $\theta r$ to the target ignition timing $\theta$ by the equation $t_a=(\theta r-\theta)\cdot T/120$. The calculated time $t_a$ is given to the timer 10. The timer 10 outputs an ignition controlling signal after the time $t_a$ passes from the time when the engine has reached the referential position, according to the calculated time $t_a$ and first pulse signal SGT given from the angle detector 3. The cylinder distinguishing signal outputted from the cylinder distinguishing unit 11 is given to a storing and learning unit 14, comparing unit 15 and selecting unit 16. The storing and learning unit 14 stores the cylinder distinguishing signal subsequently, learns the stored order, then estimates the cylinders to be ignited next, and outputs a cylinder estimating signal. The outputted cylinder estimating signal is given to the selecting unit 16 and the comparing unit 15 respectively. The comparing unit 15 compares the cylinder distinguishing signal with the cylinder estimating signal, both having been given thereto, and gives the signal of compared result to the selecting unit 16. The selecting unit 16 selects either the cylinder distinguishing signal or the cylinder estimating signal, both having been given thereto, on the basis of the signal of compared result, and outputs it as the cylinder distinguishing signal which distinguishes the cylinders to be ignited next. The ignition controlling signal outputted from the timer 10 and the cylinder distinguishing signal outputted from the selecting unit 16 are given to a distributor 12. The distributor 12 distributes the ignition controlling signal to three transistors 14*a*, 14*b*, and 14*c* according to the cylinder distinguishing signal. The transistors 14*a*, 14*b*, and 14*c* switches on/off ignition coils 13*a*, 13*b*, and 13*c* according to the distributed ignition controlling signal.

Next, explanation is given on the ignition operation of the apparatus of the present invention.

Figure 5:
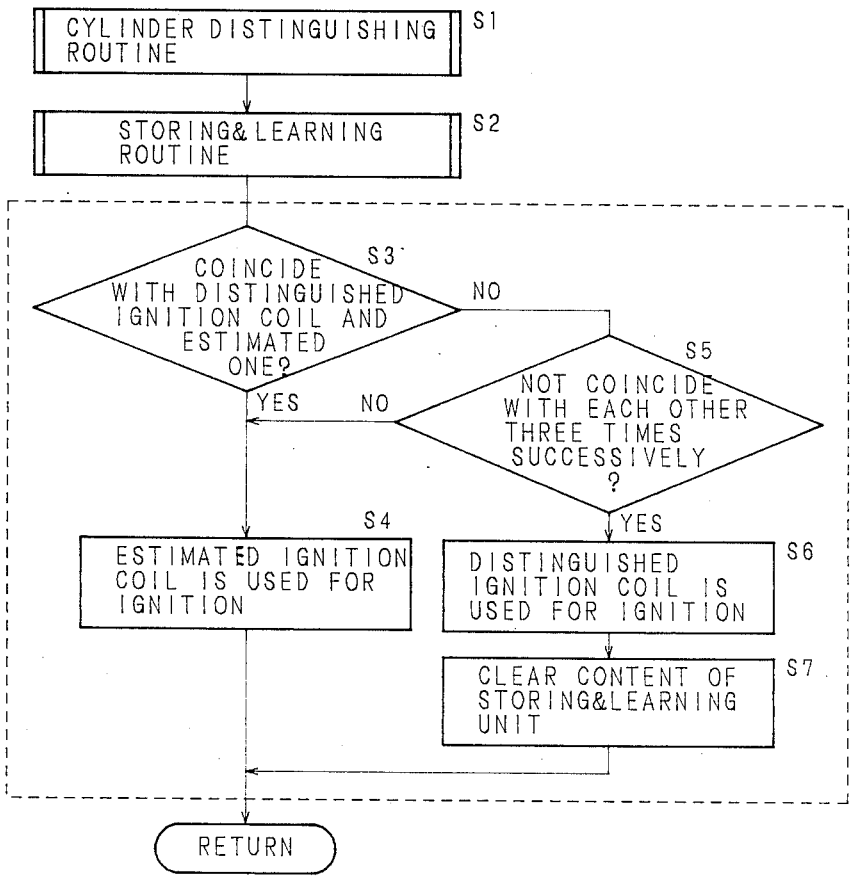
FIG. 5 is a flow chart of operation.
Figure 6:
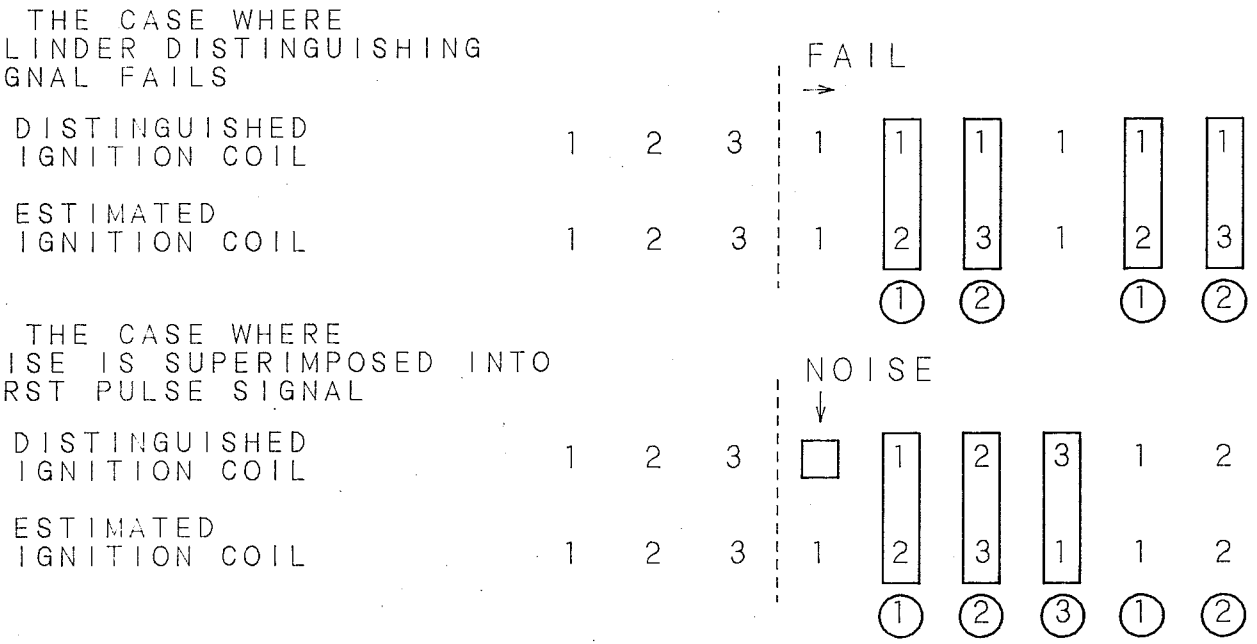
FIG. 6 is a drawing showing operational sequence.

FIG. 5 is a flow chart showing the contents of cylinder distinguishing routine, and FIG. 6 is a drawing showing the operational sequence thereof.

Figure 1:
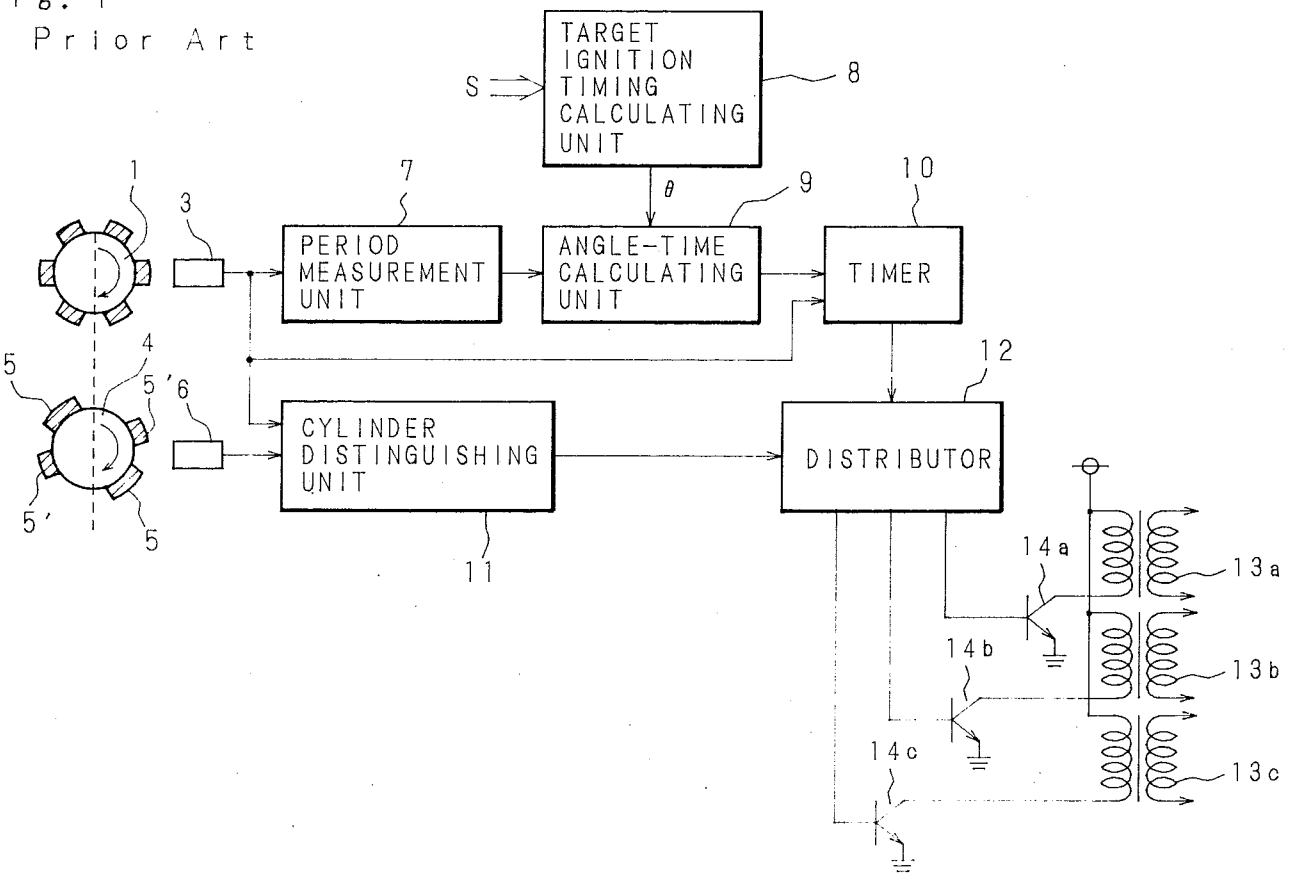
Fig. 1 Prior Art
FIG. 1 is a block diagram of a construction of a conventional ignition controlling apparatus of an internal combustion engine.
Figures 2, 3:
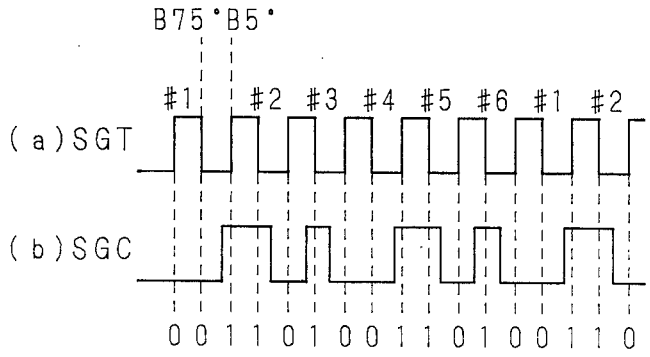
FIG. 2 is a waveform drawing of signals outputted from two detectors shown in FIG. 1.
FIG. 3 is a drawing showing a method for distinguishing cylinders.

In the processing Step S1 in FIG. 5, the distinguishment of cylinders and an ignition coil to be employed for ignition at this time is carried out in combination with the first pulse signal SGT (FIG. 2(*a*)) at its rising edge and the second pulse signal (FIG. 2(*b*)) at its falling edge shown in FIG. 3. In cylinder distinguishing storing and learning routine Step S2, processing for storing and learning the distinguishment of cylinders and an ignition coil at this time which have been processed in Step S1 is carried out, cylinder distinguishing result of every time is stored, and cylinders and an ignition coil to be employed for ignition at this time are estimated according to the series of cylinder distinguishing results which have been stored in the past. The comparing routine 20 compares the ignition coil distinguished by the cylinder distinguishing signal this time obtained from aforesaid cylinder distinguishing routine Step S1 with the distinguished ignition coil estimated from the series of cylinder distinguishing results of the past stored in the cylinder distinguishing storing and learning routine Step S2, and makes the ignition coil which has been judged normal and distinguished as the result of the comparison reflect in ignition control.

In Step S3 of the comparing routine 20, the ignition coil distinguished according to the cylinder distinguishing signal this time from the cylinder distinguishing unit 11 is compared with the ignition coil distinguished according to the cylinder estimating signal estimated from the series of cylinder distinguishing results of the past stored in the storing and learning unit 14. When both the distinguished ignition coils coincide with each other, the processing advances to Step S4, the distinguished and learned ignition coil is made to be the ignition coil to be used for igniting this time, thereby ignition controlling being carried out. In addition, in the case where both the distinguished ignition coils do not coincide with each other in Step S3, whether or not they do not coincide with each other three times successively is judged in Step S5. When they do not conflict three times successively with each other, the processing advances to aforesaid Step S4, and the distinguished and learned ignition coil is made to be the ignition coil to be used for igniting this time, thereby ignition controlling being carried out. When they do not coincide three times successively with each other, the processing advances to Step S6, the ignition coil distinguished this time according to the cylinder distinguishing signal from the cylinder distinguishing unit 11 being made to be the ignition coil to be used for igniting this time, thereby ignition controlling being carried out. When they do not coincide three times successively, the processing clears the cylinder distinguishing learning in Step S7 at the same time. The cleared cylinder distinguishing learning stores and learns the cylinder distinguishing result every time at the cylinder distinguishing storing and learning routine Step S2.

In addition, the operation of aforesaid sequence is shown in FIG. 6. FIG. 6(*a*) shows the case where the cylinder distinguishing signal fails. For the ignition coil distinguished by the cylinder distinguishing signal, it is impossible to distinguish normally after the cylinder distinguishing cylinder fails. But the normal ignition controlling is contiinued by the ignition coil based on the cylinder estimating signal estimated by the cylinder distinguishing learning. Hereupon, as both the distinguished coils do not conflict three times successively with each other, the selecting unit 16 selects the ignition coil estimated according to the cylinder distinguishing learning as the ignition coil to be used for igniting this time. When noise is superimposed into the first pulse signal SGT as shown in FIG. 6(*b*), the ignition coil estimated according to the cylinder distinguishing learning shifts, thereby normal distinguishing being impossible. But when it is compared with the ignition coil distinguished this time, both the distinguished ignition coils do not coincide three times successively. Accordingly, the selecting unit 16 immediately selects the ignition coil distinguished by the cylinder distinguishing signal as the ignition coil to be used for igniting this time.

The present invention, as described above, is capable of distinguishing cylinders normally even in the case where the cylinder distinguishing signal fails, and also is capable of returning immediately to the normal operational state even in the case where the wrong operation is detected, since it is devised to compare the distinguished cylinders this time with the learned distinguished cylinders by the use of aforesaid comparing means even when the cylinder distinguishing means is abnormal, and to carry out ignition controlling according to either of these cylinder distinguishing informations on the basis of the compared result.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An ignition controlling apparatus for a multicylinder internal combustion engine comprising:

cylinder distinguishing means for distinguishing at least one cylinder related to a cylinder necessary to be ignited next among plural cylinders and for outputting successively distinguishing information indicating the distinguished cylinders;

storing and learning means for storing successively the distinguishing information outputted from said cylinder distinguishing means, for estimating cylinders corresponding to said distinguishing information on the basis of the stored distinguishing information, and for outputting estimating information indicating the estimated cylinders;

comparing means for comparing the estimating information with the distinguishing information;

selecting means for selecting either the estimating information or the distinguishing information on the basis of the compared result; and distributing means for distributing an ignition controlling signal to the cylinder to be ignited next on the basis of the selected information.

2. An ignition controlling apparatus as set forth in claim 1, wherein said cylinder distinguishing means distinguishes the cylinders on the basis of the detected result of a rotation sensor which detects a rotational angle of said internal combustion engine according to a pulse signal generated by a predetermined rotational angle.

3. An ignition controlling apparatus as set forth in claim 2, wherein said cylinder distinguishing means has a first rotation sensor and a second rotation sensor which detect the rotational angle of said internal combustion engine according to first and second pulse signals, and distinguishes each cylinder by detecting the state of the second pulse signal outputted from said second rotation sensor whose phase is different from that of the first pulse signal outputted from said first rotation sensor at the timing of change of the first pulse signal which changes the state thereof according to the predetermined rotational angle of each cylinder.

4. An ignition controlling apparatus as set forth in claim 1, wherein said storing and learning means learns storing order of the stored distinguishing information, and outputs said estimating information according to the learned storing order.

5. An ignition controlling apparatus as set forth in claim 1, wherein said internal combustion engine is a four-cycle N-cylinder ($N \geqq 2$: integer) engine, and has one ignition coil in every two cylinders.

6. An ignition controlling apparatus as set forth in claim 5, wherein, when said compared results do not coincide N/2 times successively, said selecting means selects the distinguishing information outputted from said cylinder distinguishing means and said storing and learning means clears the stored contents.

7. An ignition controlling apparatus as set forth in claim 6, wherein, when said compared results do not coincide $2/N-1$ or fewer times successively, said selecting means selects the estimating information outputted from said storing and learning means.

8. An ignition controlling apparatus as set forth in claim 1, wherein said internal combustion engine is a four-cycle six-cylinder engine, and has one ignition coil in every two cylinders.

9. An ignition controlling apparatus as set forth in claim 8, wherein, when said compared results do not coincide three times successively, said selecting means selects the distinguishing information outputted from said cylinder distinguishing means and said storing and learning means clears the stored contents.

10. An ignition controlling apparatus as set forth in claim 9, wherein, when said compared results do not coincide two or fewer times successively, said selecting means selects the estimating information outputted from said storing and learning means.

* * * * *